United States Patent [19]

Rikker

[11] 4,177,952

[45] Dec. 11, 1979

[54] IMPACT SCRUBBER

[75] Inventor: Leslie D. Rikker, Oak Forest, Ill.

[73] Assignee: National Engineering Company, Chicago, Ill.

[21] Appl. No.: 899,226

[22] Filed: Apr. 24, 1978

[51] Int. Cl.[2] ..... B02C 23/18

[52] U.S. Cl. ..... 241/40; 241/42; 241/52; 209/144

[58] Field of Search ..... 241/40, 42, 24, 52

[56] References Cited

U.S. PATENT DOCUMENTS

| | | | |
|---|---|---|---|
| 2,354,311 | 7/1944 | Harlow | 209/144 |
| 2,813,318 | 11/1957 | Horth | 241/24 X |
| 2,939,189 | 6/1960 | Wenninger | 241/40 X |
| 3,088,183 | 5/1963 | McIlvaine et al. | 241/52 |
| 3,543,931 | 12/1970 | Rastatter | 209/144 X |
| 3,825,190 | 7/1974 | Kauffman | 241/40 |
| 3,907,213 | 9/1975 | Kauffman | 241/40 |

*Primary Examiner*—Robert L. Spicer, Jr.
*Attorney, Agent, or Firm*—Mason, Kolehmainen, Rathburn & Wyss

[57] ABSTRACT

An impact scrubber for removing coating materials from the surfaces of particulate matter such as foundry sand and the like comprises a lift tube open adjacent upper and lower ends for containing a high velocity fluidized stream of said particulate matter. A fluid injector is mounted adjacent the lower end of the lift tube for moving the particulate matter into the lift tube to form an upwardly flowing, high velocity turbulent fluidized stream. An adjustable inlet valve is provided adjacent the fluid injector for regulating the flow of sand into the high velocity stream of fluid moving into the lift tube. A target is spaced above the open upper end of the lift tube providing an impact area for receiving the flow of high velocity fluidized particulate matter which impacts against the target. The coating material is loosened from the sand grains by the impact at the target and during the turbulent flow. The separated, heavier sand particles and the lighter coating materials are deflected downwardly by the target and a secondary fluid flow is provided to move outwardly of the lift tube for intercepting the downward curtain of particulate matter and coating materials and carrying away the lighter coating materials while permitting the heavier sand grains to continue to fall downwardly. An outlet fluid exhaust valve is provided for adjustably controlling the outflow of air and coating materials that are removed from the sand grains. A plurality of scrubbing units as described are arranged in series and a novel baffle system is provided to deflect a portion of the material from one unit into the next unit and recycle the remaining portion. Metering devices are provided for controlling the inflow and outflow of particulate matter and cleaned sand grains through the scrubber.

32 Claims, 9 Drawing Figures

FIG. 2
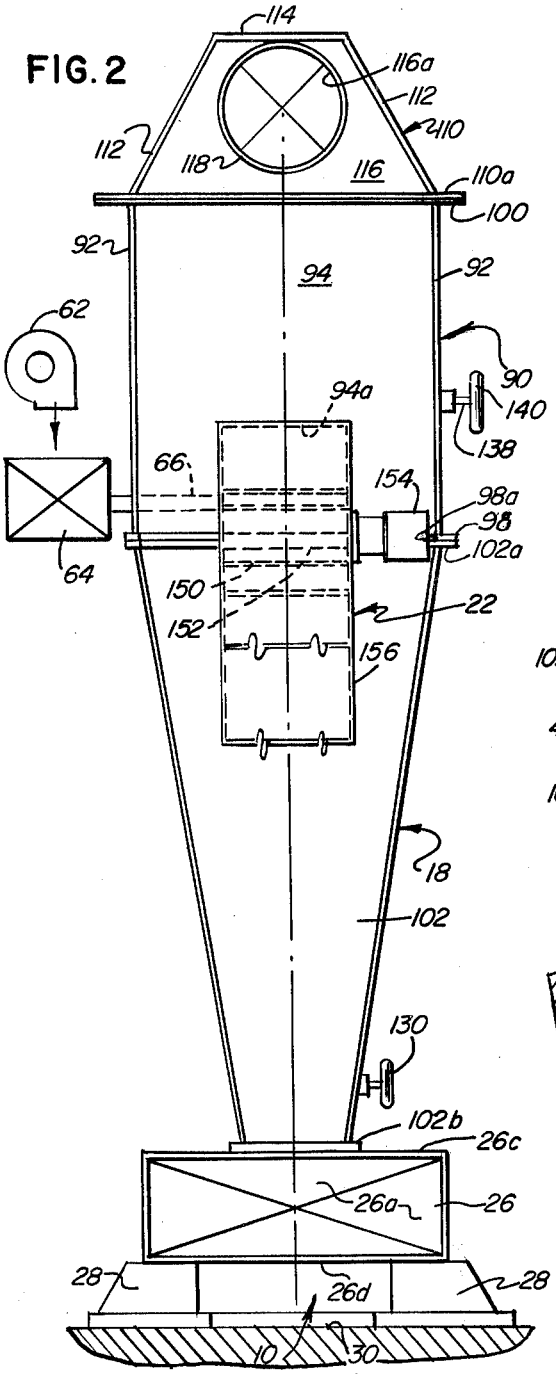
FIG. 3
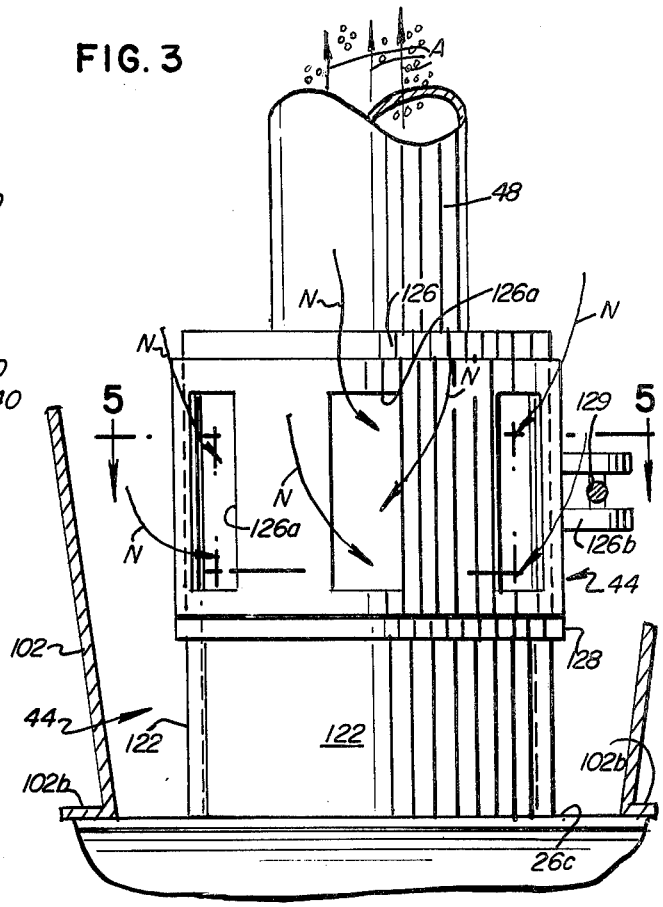
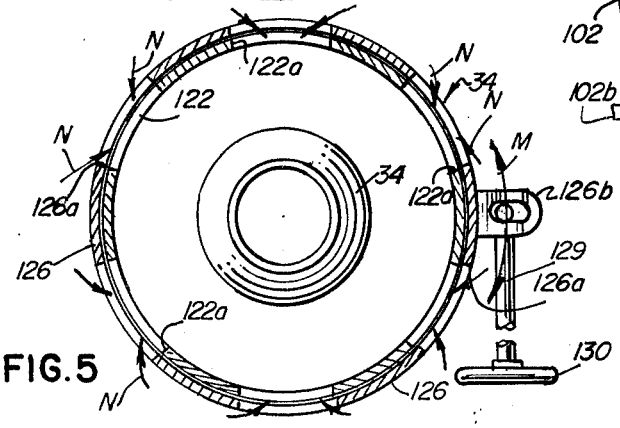
FIG. 5
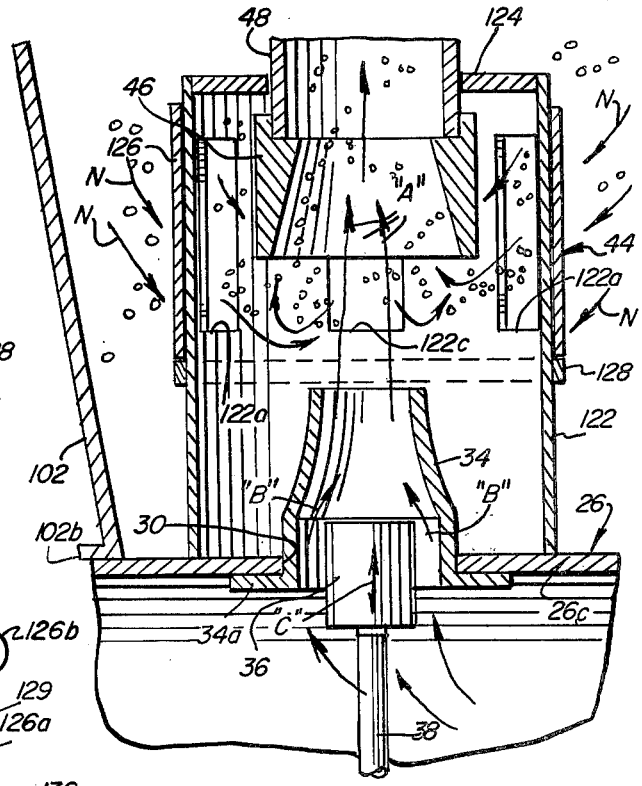
FIG. 4

FIG. 6
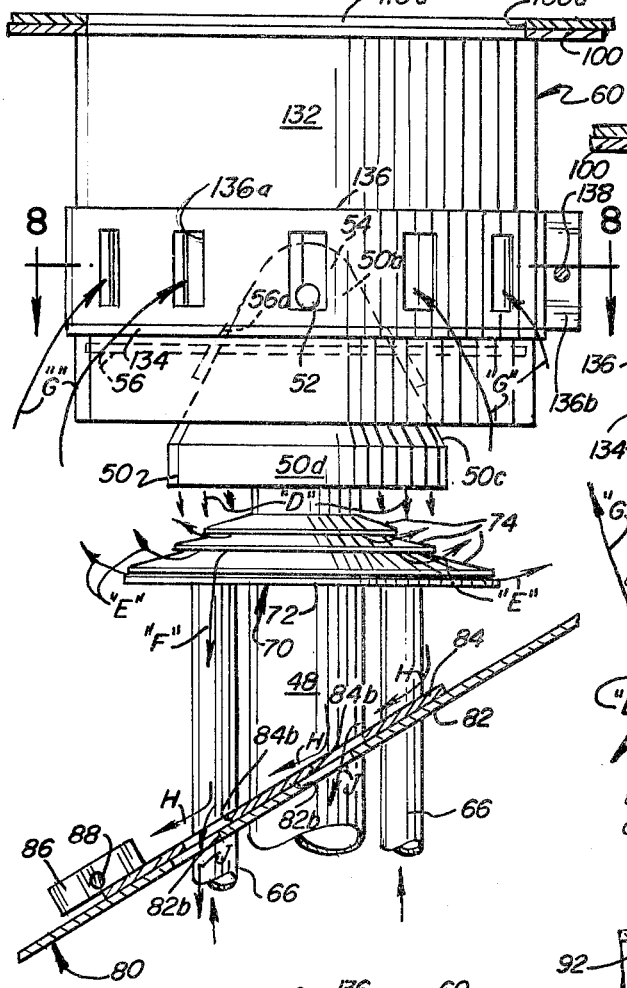
FIG. 7
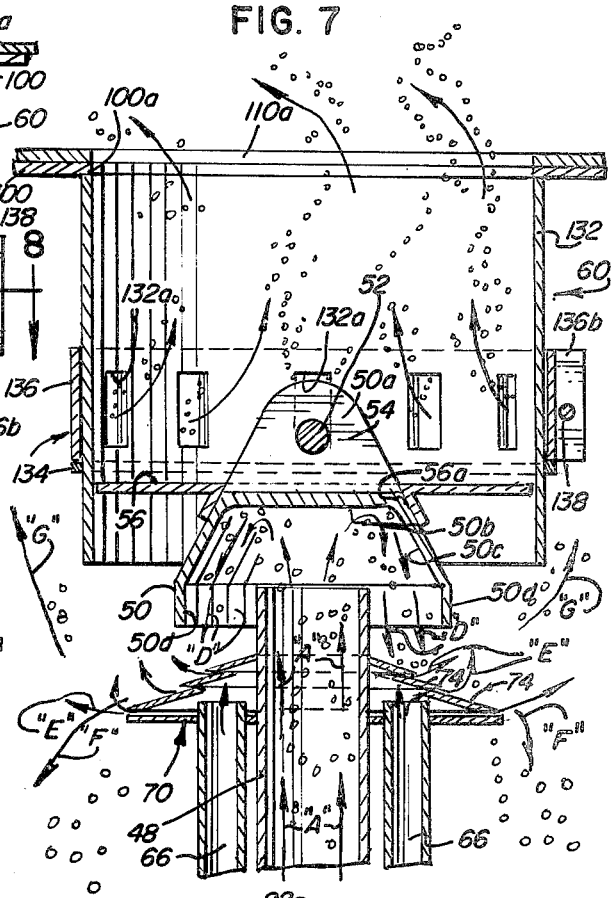
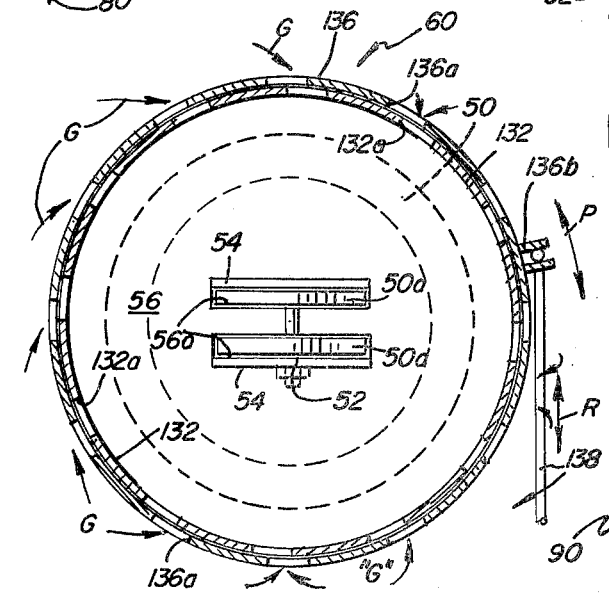
FIG. 8
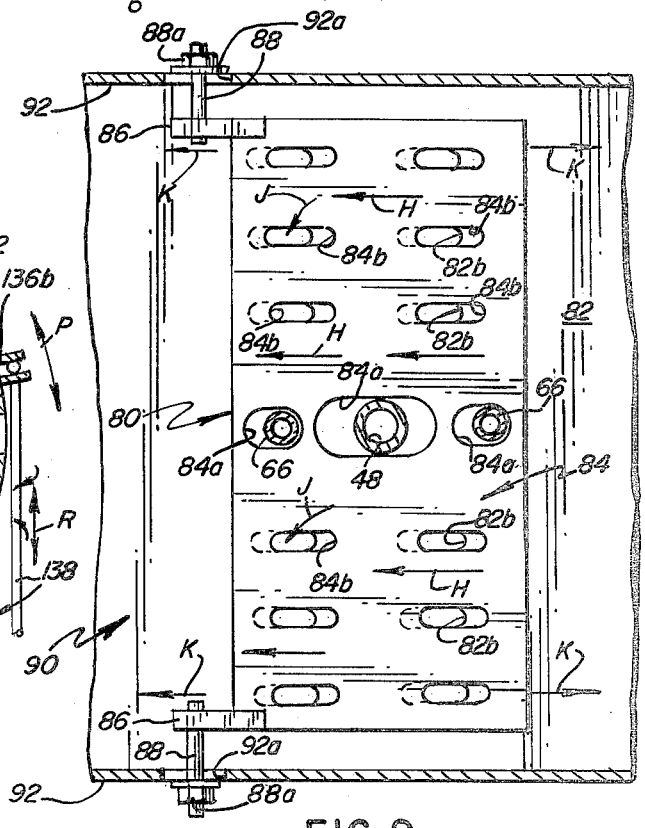
FIG. 9

IMPACT SCRUBBER

BACKGROUND OF THE INVENTION

1. Field of the Invention

The present invention relates to impact scrubbers for removing coating materials from the surface of particulate matter. More particularly, a new and improved scrubber is especially designed for removing coatings of binding materials from spent foundry sand and the like. The impact scrubber of the invention is also useful in treating a wide variety of other particulate materials which have unwanted coatings of material thereon which are removed by impact and are then separated from the main particles because of their lighter weight.

2. Description of the Prior Art

U.S. Pat. Nos. 2,813,318; 3,088,183; 3,825,190 and 3,907,213 disclose impact type sand scrubbers useful in the reclamation of spent foundry sand. These patents are owned by the same assignee as the present application and the invention shown and described herein constitutes an improved impact scrubber for the removal of coating materials from the surface of particulate matter.

It is an object of the present invention to provide a new and improved impact scrubber for removing coating materials from the surfaces of the particulate matter, such as foundry sand and the like.

More specifically it is an object of the invention to provide a new and improved impact scrubber which is especially well suited for removing binders and other coating materials from spent foundry sand and the like.

Another object of the present invention is to provide a new and improved impact scrubber of the character described which is highly efficient in operation, relatively low in cost, relatively low in cost of operation and which requires a minimal amount of servicing and maintenance.

Yet another object of the present invention is to provide a new and improved impact scrubber of the character described which employs a secondary fluid stream for effecting separation of the coating materials which are removed from the base particulate matter.

Yet another object of the present invention is to provide a new and improved impact scrubber having means for adjustably controlling the sand flow and the secondary air flow which remove the lighter fines from the particulate matter that is being cleaned.

Still another object of the present invention is to provide a new and improved impact scrubber of the character described having a plurality of operating units or cells operatively connected in series with novel baffle means for dividing the output of one cell between an imput flow to the next cell and a recycle flow which is returned to the same cell for further treatment.

Yet another object of the present invention is to provide a new and improved impact scrubber of the character described having novel flow control means for discharging the cleaned or finished product at a prescribed flow rate.

Yet another object of the present invention is to provide a new and improved impact scrubber of the character described which requires a minimal volume of fluid flow yet provides exceptional quality and control and is extremely efficient in separating the unwanted coating materials from the base particulate matter.

Still another object of the present invention is to provide a new and improved impact scrubber of the character described which employs both a primary and a secondary fluid system for more efficient operation.

Still another object of the present invention is to provide a new and improved impact scrubbing device of the character described wherein a primary air or fluid flow is utilized for impacting the material against a target and a secondary fluid or air flow is utilized for separating the unwanted coating materials from the base particulate matter.

Yet another object of the present invention is to provide a new and improved impact scrubber for granular material and the like which requires a much lesser volume of air flow per pound of product handled than heretofore thought possible.

Still another object of the present invention is to provide a new and improved impact scrubber which can be tuned and adjusted to provide maximum scrubbing action with a minimum amount of energy expanded per unit of material being treated.

Yet another object of the present invention is to provide a new and improved impact scrubber of the character described which requires a lesser volume of high pressure primary fluid flow by providing an adjustably controllable secondary air flow at lower pressure for removal of the unwanted coating materials from the base product.

Another object of the present invention is to provide a new and improved impact scrubber which has a much lower operating expense than theretofore thought possible and which requires less maintenance and servicing because of improved design and reduced wear characteristics.

BRIEF SUMMARY OF THE INVENTION

The foregoing and other objects and advantages of the present invention are accomplished in an illustrated embodiment which comprises a new and improved impact scrubber adapted for removing coating materials from the surfaces of particulate matter such as spent foundry sand and the like. The scrubber includes one or more lift tubes arranged in series and open adjacent their upper and lower ends for containing a high velocity, turbulent fluidized stream of the particulate matter. A fluid injector is provided adjacent the lower inlet end of each lift tube for carrying the matter into the lift tube to form the fluidized stream and an adjustable inlet valve is provided adjacent the injector for regulating the flow of the particulate matter into the lifting stream. A target is spaced above the upper outlet end of each lift tube to provide an impact area for receiving and deflecting downwardly the high velocity fluidized stream of particulate matter. As the particulate matter impacts or strikes the targets, the coating materials on the sand grains are cracked, broken and knocked off and the heavier, base particulate matter drops downwardly in a curtain while the lighter weight coating material or fines are separated by means of a secondary fluid system which provides a flow of secondary fluid which passes outwardly through the curtain of falling material. The secondary air picks up and carries away the lighter weight coating materials or fines and the cleaned particulate material continues downwardly. The flow of secondary air is adjustable to provide precise control of the amount of fines separated out and this control precision minimizes the amount of secondary fluid required. The cleaned sand from one target is divided by a baffle system and a portion is directed towards a successive lift tube unit while another portion is recycled again in the same unit. A number of lift tube units are interconnected in series and the material initially entering the scrubber is impaced against the targets several times. The clean sand or finished product leaving the last lift tube is previsely metered and this further reduces the operating costs and provides a more or less constant flow rate of material through the scrubber.

BRIEF DESCRIPTION OF THE DRAWINGS

For a better understanding of the present invention, reference should be had to the following detailed description taken in conjunction with the drawings in which:

FIG. 2 is a front elevational view at the outlet end of the scrubber;

FIG. 3 is an enlarged, elevational view of the lower end of a scrubber cell showing the material inlet gate valve mechanism thereof;

FIG. 4 is an enlarged, vertical, sectional view similar to FIG. 3 illustrating the interior of the fluid injector and inlet end of the lift tube and associated material gate valve assembly;

FIG. 5 is a horizontal, cross-sectional view taken substantially along lines 5—5 of FIG. 3;

FIG. 6 is a fragmentary, enlarged, elevational view of an upper end portion of the scrubber cell;

FIG. 7 is a vertical cross-sectional view similar to FIG. 6;

FIG. 8 is a horizontal, cross-sectional view taken substantially along lines 8—8 of FIG. 6; and FIG. 9 is a cross-sectional view taken substantially along lines 9—9 of FIG. 1.

DESCRIPTION OF THE PREFERRED EMBODIMENT

Figure 1:
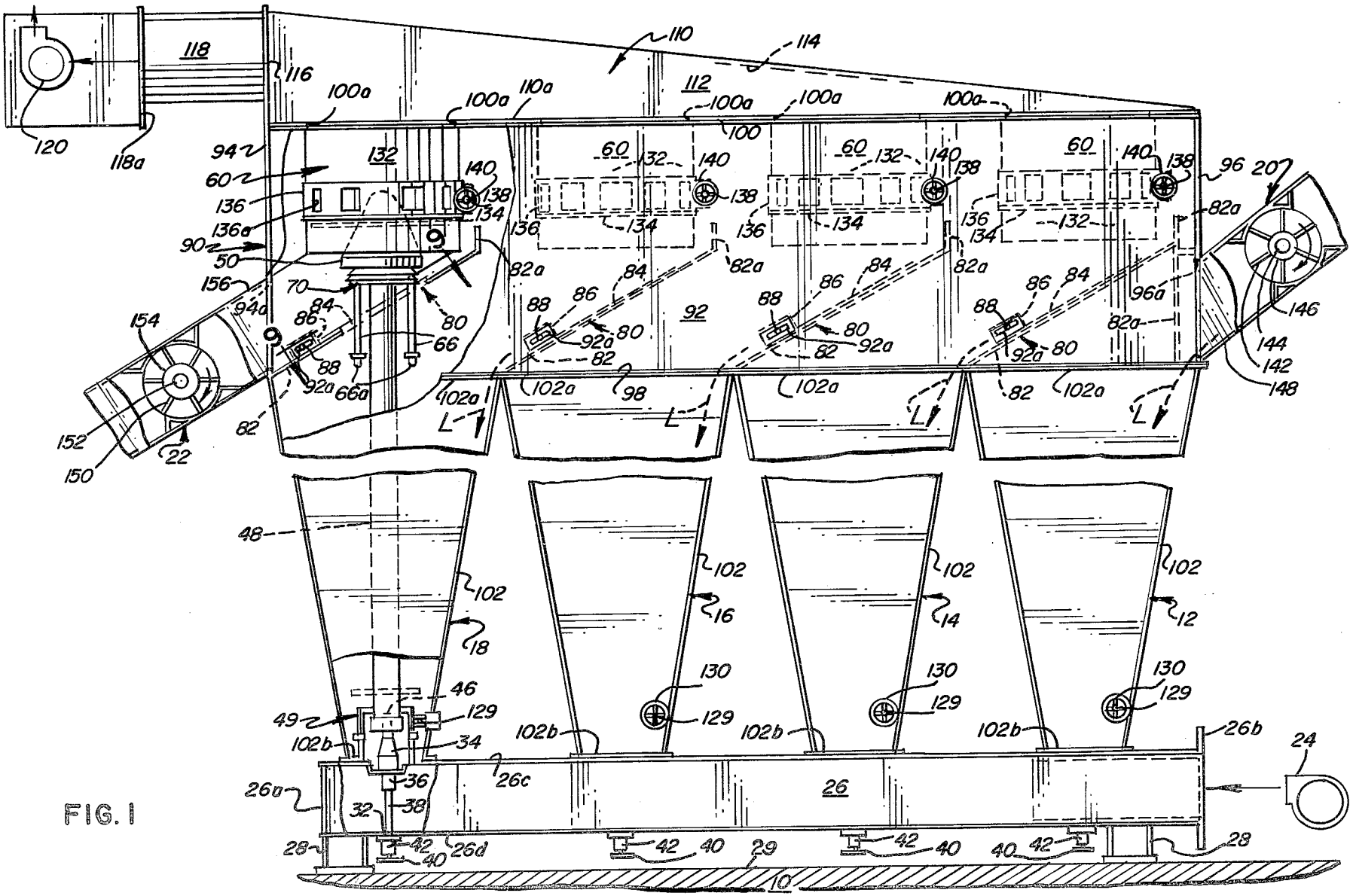
FIG. 1 is a side elevational view of a new and improved impact scrubber constructed in accordance with the features of the present invention with portions cut away and in section for clarity.

Referring now more particularly to the drawings, therein is illustrated a new and improved impact scrubber for removing unwanted coating materials from particulate materials such as spent foundry sand and the like. The impact scrubber operates generally on a principle of forming a high velocity turbulent, fluidized stream of particulate material and impacting this stream against a target so that the unwanted coating materials are cracked and broken off from the base material or sand grains. The coating materials or fines are lighter than the sand grains and a controlled fluid flow is used to remove the fines from the base material. The scrubber of the present invention is referred to generally by the reference numeral 10 and includes a plurality of individual impact type scrubber cells or units 12, 14, 16 and 18 which are serially arranged to successively receive the particulate material as it passes from unit to unit through the scrubber. The material is introduced through an inlet 20 adjacent the first scrubber cell 12 and moves through each cell until reaching an outlet 22 adjacent the final scrubber cell 18. Compressed air is used for moving the material through the scrubber cells and is supplied from a blower 24 or high speed rotary compressor. This primary fluid is supplied to the inlet end of a rectangular cross-sectioned elongated plenum chamber 26 which in turn provides a high velocity flow of pressurized air to the respective scrubber cells, while supporting the cells in upstanding position on the plenum as shown in FIGS. 1 and 2. The plenum chamber 26 serves as a base of frame for the scrubber 10 and is provided with a plurality of supporting feet 28 at opposite ends which transfer the weight of the scrubber to a floor 29 or other suitable supporting structure.

As illustrated, the primary air plenum is closed at one end **26*a* adjacent the final scrubber cell 18 and is provided with a flanged inlet 26*b* at the opposite end which is connected to the primary air blower 24 by suitable duct work (not shown). The plenum includes a rectangular top wall 26*c* and a similarly shaped bottom wall 26*d* spaced therebelow and pairs of concentrically, vertically aligned, circular openings 30 and 32 are formed in the respective top and bottom walls. Each pair of openings is in coaxial, vertical alignment with the vertical center axis of a respective scrubber cell 12, 14, 16 and 18**.

Each scrubber cell includes a convergent type fluid inlet nozzle 34 having a flange **34*a* at the lower end seated in one of the circular openings 30 in the top wall 26*c* of the plenum as shown in FIG. 4. The nozzle 34 is adapted to direct pressurized air from the plenum chamber 26 upwardly into the scrubber cell in a high velocity flow or jet as indicated by the vertical arrows "A" in FIG. 4**.

In order to prevent sand from the respective scrubbing cells from flowing downwardly through the nozzles 34 when the plenum 26 is not under pressure, each nozzle is provided with a closure plug 36 mounted at the upper end of a vertical transverse rod 38 for movement between an upper or closed position wherein the outlet end of a nozzle 34 is plugged and a downward or open position as shown wherein a relatively free flow of air from the plenum as represented by the arrows "B" is provided. Intermediate positions of the closure plugs 36 are achieved by vertical adjustment of the rods 28 and this provides for precise air flow control of the air entering the lower end of the nozzles 34 from the pressurized plenum chamber 26. As indicated by the arrow "C" (FIG. 4), the position of the plugs relative to the tapered portion of the respective nozzles 34 controls the volume flow rate of air into the scrubber cells.

The control rods 38 are adjusted vertically by means of hand wheels 40 which are spaced below the bottom wall **26*d* of the plenum and each hand wheel is associated with a gear box assembly 32 for raising and lowering the rod in response to the rotation of the hand wheel. It will thus be seen that the individual hand wheels 40 can be turned causing the closure plugs 36 to move upwardly into the outlet end of the nozzles 34 to substantially and completely shut off the air flow into a scrubber cell and when this is done, the sand is not permitted to flow downwardly into the plenum chamber when the plenum is depressurized. After the plenum chamber has been pressurized by turning on the blower 24, the closure plugs are then moved downwardly out of the closed position and this action permits the pressurized air to flow upwardly into the respective scrubber cells as regulated by the position of the closure plugs 36 relative to the outlet ends of the respective nozzles 34. Each of the scrubber cells 12, 14, 16 and 18 can be regulated independently of the others with respect to the primary air flow by adjustment of the hand wheels 40**.

In accordance with an important feature of the present invention, the flow rate of sand into the fluid stream or jet issuing from the nozzle 34 of each scrubber cell is controlled by means of a cylindrical gate valve assembly generally indicated by the reference numerals 44 and shown in detail in FIGS. 3, 4 and 5. As illustrated, the sand flows downwardly and inwardly into the path of the high velocity jet of air moving upwardly as indicated by the arrow "A" and the sand is carried upwardly in a high velocity, highly turbulent, fluidized stream. The sand and air jet move upwardly into a convergent type, replaceable, annular inlet collar 46 mounted on the lower end of a centrally disposed, vertical, lift tube provided for each scrubber cell and indicated by the reference numeral 48.

As the high velocity, fluidized stream of particulate matter or spent foundry sand moves up the lift tube and eventually passes out the open upper end, it is impacted against the underside of a bell-shaped target 50 provided at the upper end of each scrubbing cell 12, 14, 16 and 18. During the upward travel in the lift tube 48, the individual sand particles are repeatedly impacted against one another by the turbulent flow conditions and the coating materials break off and begin to separate from the base material or particulate matter such as the sand grains. A further impacting is achieved as the particulate material or sand grains strike the underside of the target which usually holds a cushion of sand material at the center of the bell-shaped enclosure. In this area or vicinity, additional coating material is removed and dislodged from the base material or sand grains.

Each target 50 is supported by a pair of integrally formed, spaced apart, upstanding lugs 50*a* having aligned circular openings therein for receiving a horizontal support pin 52 which is extended through openings in a pair of upstanding brackets 54. The pins are removable so that the targets can be replaced from time to time if necessary. The brackets are mounted on a circular bottom wall 56 located at mid level of a generally cylindrical, air flow, regulating exhaust gate valve assembly provided for each scrubber assembly and generally indicated by the reference numeral 60 (best shown in FIGS. 6, 7 and 8). The support lugs 50*a* on the targets 50 project upwardly through rectangular slots 56*a* formed adjacent the center of the exhaust valve bottom walls 56 and when a target 50 becomes worn and needs replacing, the support pin 52 is removed and the target is dropped downwardly until the lugs 50*a* pass below the circular wall 56. The target is then removable from the underside of the gate valve assembly 60 and a new or reconditioned target may be installed in place and again secured in position with a pin or bolt 52.

Each of the targets 50 includes a circular, flat central portion 50*b* (FIG. 7) coaxially aligned with the axis of a corresponding lift tube 48 and spaced an appropriate distance above the upper end of the lift tube as shown in FIG. 7. The targets also include an outwardly and downwardly tapering frustroconical segment 50*c* that terminate in a generally cylindrical, lower band or skirt 50*d* which forms the downwardly flowing material into an annular curtain comprising a mixture of fines and heavier base particulate matter as represented by the arrows "D" in FIGS. 6 and 7.

In accordance with the present invention, the annular, downwardly flow curtain of fines and sand grains from each target skirt 50*d* is intercepted by a radially outwardly extending flow of secondary air (represented by the arrows "E") and this secondary air flow is used to separate the fines which are lighter in weight from the base material or sand grains which are much heavier and continue to cascade downwardly. The secondary air flow is supplied by means of a blower 62 (FIG. 2) which is connected by suitable duct work (not shown) to an elongated horizontal plenum 64 running along one side of the scrubber. Each of the scrubber cells 12, 14, 16 and 18 is supplied with secondary air from the plenum chamber 64 by a pair of supply conduits 66 having vertical segments extending parallel of the central lift tube 48 on opposite sides thereof as shown in FIGS. 6, 7 and 9. Each secondary air conduit 66 also includes a horizontal section which extends outwardly from an elbow 66*a* (FIG. 1) to be interconnected at its outer end to the plenum chamber.

Each pair of vertically extending portions of the supply conduits 66 project upwardly into the generally frustroconically shaped, secondary air outlets 70 or "Christmas Tree" mounted adjacent the upper open end of the corresponding lift tube and spaced concentrically therewith a distance downwardly below the lower edge of the skirt 50*d* of the adjacent target 50. The secondary air outlets are shaped somewhat like "Christmas Trees" and each includes an annular, circular bottom wall 72 and a plurality of frustroconically shaped annular collars or roofs 74 spaced upwardly thereof and spaced apart from one another to form thin outlets for directing an outward flow of secondary air toward the annular sand curtain. The secondary fluid which is supplied to the interior of the outlets 70 through the supply conduits 66 is of a relatively low pressure in comparison to the primary supply.

A bottom edge of each of the annular collars or roofs 74 is spaced slightly above the upper level of the upper edge of the next lower collar and the lowest collar is spaced just above the upper level of the bottom wall 72. This spacing directs the secondary air flow radially outward of the lift tubes 48 as represented by the arrows "E" to directly intercept the downwardly flowing annular curtain of material represented by the arrows "D" whereby separation of the lighter weight fines from the heavier base material or sand grains is achieved in an annular separation zone. The sand grains are heavy relative to the fines and are not bouyed or carried away by the high velocity of the secondary air stream flowing outwardly and the heavier sand grains continue to fall onto the next lower sloping roofs 74 and eventually move down to the lower edge of the lowermost roof to spill off downwardly around the outer edge as represented by the arrows "F".

The secondary air flow carries the lighter weight fines outwardly and upwardly towards the exhaust valve assemblies 60 as illustrated by the arrows "G" to effect separation of these fines from the base material sand grains. The pressure, and thus, the velocity of the secondary air flow as represented by the arrows "E" is adjustable and is selected by controlling the power input to the secondary air blower 62. This control permits the desired amount of fines to be removed in the separation process taking place in the separation zone around the lower edges of the targets 50 and the upper surfaces of the roofs 74 of the secondary air outlets 70. Because a different source of secondary air is provided, the primary air which is required for impacting the material against the targets can be reduced in volume since this air does not also have to be utilized as a means of separating the fines. The secondary air flow can be precisely controlled so that as a whole overall, a great reduction in air flow required is possible because of the novel design.

In addition, the blower 62 supplying the secondary air may be a relatively low pressure, high volume type blower while the primary lift tube air supplied by the primary blower 24 is of low volume and relatively high pressure. The energy savings provided by utilizing two separate sources of fluid for related purposes provides an extremely efficient operation and comprises a major advance over the prior art sand scrubbers of the impact type.

In accordance with the present invention, each scrubber cell 12, 14, 16 and 18 is provided with a baffle system 80 for dividing the flow of material falling downwardly in a curtain around and from the lower edge of the secondary air outlets 70 into a first portion which is directed into the next adjacent scrubber cell and a second portion which is directed back to the originating cell for recycling. Each baffling system 80 includes a slotted, fixed lower plate 82 having a lower edge adjacent an outlet side of the scrubber cell and sloping upwardly toward an inlet edge with a vertical segment 82*a* provided at the level of the adjacent exhaust valve assembly 60 as shown best in FIG. 1. As illustrated in FIGS. 6 and 9, the fixed lower plates 82 are formed with a trio of centrally aligned slots for accommodating the lift tube 48 and the secondary air supply conduits 66 on opposite sides thereof. In addition, each fixed plate is formed with a plurality of elongated slots 82*b* forming material flow passages which are adapted to cooperate with similarly located elongated slots 84*b* provided in an adjustably movable gate baffle 84 which is disposed for sliding movement on the upper surface of the fixed lower plate 82.

As best illustrated in FIGS. 6 and 9, the material flowing downwardly from the lower edge of the "Christmas Trees" 70 (as indicated by the arrows "F") strikes the sloping baffle structure 80 and a portion thereof moves down the baffle as indicated by the arrows "H" whereas a recycling portion of material flows downwardly through the aligned overlying slots 84*b* and 82*b* in the respective baffle members 84 and 82 as indicated by the arrows "J" for subsequent recycling. The relative position of the adjustable baffles or gates 84 on the underlying support plates 82 provides for selective control of the alignment between pairs of slots 82*b* and 84*b* in the respective baffle members. The effective flow area through the slots of baffle structures 80 can then be increased and decreased by movement and repositioning of the gate or upper baffle structure 84 into different selected position as indicated by the arrows "K", and thus, the proportion or fraction of material that is recycled can be selectively adjusted and controlled as desired.

Movement of the upper baffle 84 is achieved by a pair of brackets 86 and outwardly extending rods 88 which pass through elongated slots 92*a* formed in the opposite side walls of an upper head chamber 90 which encloses and houses the exhaust valve assemblies 60 of each of the respective scrubber cells 12, 14, 16 and 18. As best shown in FIGS. 1 and 2, the upper head chamber is of a rectangular cross-section and includes a pair of opposite side walls 92 with the sloped, elongated slots 92*a* formed therein for permitting movement of the baffle control rods 88 to selected positions by manipulation from outside of or externally of the head chamber. Once the desired upper baffle position is achieved, the rods are secured in place by the use of lock nuts 88*a* or other suitable fasteners which are tightened against the outside surfaces of the opposite side walls 92 to fix the baffle 84 of each baffle assembly 80 in the desired flow position.

The head chamber includes a front end wall 94, a rear end wall or inlet end wall 96, a bottom wall 98 and a top wall 100 which includes a row of large, circular, exhaust flow openings 100*a* (FIG. 7) for exhausting the air and fines from the scrubber. An exhaust valve gate assembly 60 is coaxially aligned with each of the respective exhaust or outlet openings 100*a* and the top wall of the head chamber 90 supports each gate assembly which depends downwardly therefrom as best shown in FIGS. 6 and 7. The bottom wall 98 of the head chamber is formed with a row of large, circular, sand flow openings 98*a* in communication with the enlarged upper end of a conically shaped sand hopper 102 provided for each of the scrubber cells 12, 14, 16 and 18 and aligned in coaxial, parallel, alignment with the central lift tube 48 of the respective scrubber cell. The conical hoppers are shaped to taper downwardly to a minimum diameter at the lower end which is supported in coaxial alignment on the upper wall 26*c* of the high pressure, primary, air plenum 26. The lower end of the hopper of each scrubber cell is in coaxial alignment with a circular opening 30 provided in the top wall 26*c* of the plenum and as best shown in FIG. 2, each hopper is provided with an annular, upper, horizontal flange 102*a* secured to the underside of the head chamber bottom wall 98 around an opening 98*a* and a lower flange 102*b* secured to the upper surface of the top wall 26*c* of the primary, air plenum 26 around an opening 30. It will thus be seen that the flow of target impacted material falling downwardly through the pairs of aligned slots 82*b* and 84*b* on the respective baffle assemblies 80 flows toward the lower end of the hopper 102 on each scrubber cell. This material then flows via the sand inlet gate valve assemblies 44 into the fluidized stream in a lift tube 48 and is again impacted against a target 50 in a recycling process.

The sand falling on the respective baffle assemblies 80 which does not pass through the aligned slots 82*b* and 84*b* into the underlying hopper 102 for recycling, passes down the baffle assembly into the hopper 102 of the next adjacent scrubber cell as indicated in FIG. 1 by the arrows "L", and thus, it will be seen that the output of material from the target of each scrubber cell is divided into two part streams or portions, one of which moves onto the next scrubber cell and the other of which moves into the originating scrubber cell for recycling.

The exhaust air and the fines carried thereby move through the exhaust valve gate assemblies 60 upwardly through the exhaust openings 100*a* in the top wall 100 of the head chamber 90 into a tapered exhaust manifold 110 of trapezoidal, transverse, cross-sectional shape as shown in FIG. 2. The exhaust manifold tapers from a minimum height adjacent the first or inlet scrubber cell 12 to a maximum height adjacent the final or outlet scrubber cell 18. The manifold includes a bottom flange 110*a* secured to the upper surface of the top wall 100 around the perimeter thereof and also includes a pair of upwardly and inwardly tapering side walls 112 and a sloping top wall 114. The side walls and top walls terminate at an outlet end wall 116 having a circular exhaust opening 116*a* connected to an exhaust duct 118 having a flanged outer end 118*a*. The exhaust duct is connected by suitable duct work (not shown) to an exhaust fan or blower 120 shown schematically in FIG. 1. The secondary air supplied to the "Christmas Trees" 70 by the secondary air blower 62 via the secondary plenum chamber 64 and the primary air supplied to the individual scrubber cells 12, 14, 16 and 18 from the primary air plenum chamber 26 and the primary blower 24 is exhausted from the scrubber 10 through the respective exhaust valve gate assemblies 60 in the upper head chamber 90 by the exhaust fan 120. This fan moves the exhausted air and the fines carried thereby upwardly from the respective scrubber cells into the exhaust manifold 110 and the fan may be adjusted to maintain a slight negative pressure in the head chamber 90 to prevent leakage of fines into the area around the scrubber.

Referring now more particularly to FIGS. 1, 3, 4, and 5, the sand inlet gate assemblies 44 in each of the scrubber cells 12, 14, 16 and 18 include an upstanding cylindrical housing 122 mounted on the upper wall **26*c* of the primary plenum 26 in concentric alignment around the nozzle openings 30. The cylindrical housings provide laterial support and alignment for the lower end portion of the lift tubes 48 and are formed with annular top walls 124 having a central opening therein to accommodate the lift tube as shown in FIG. 4. The housings 122 are provided with a plurality of circular, circumferentially spaced apart, rectangular slots 122*a* in a ring around the upper portion thereof in order to permit the inflow of sand into the interior as indicated by the arrows "N". The inlet openings 122*a* are adapted to cooperate with similar rectangular openings 126*a* provided in an outer cylindrical gate 126 which is mounted for rotation around the upper portion of the housing 122 and supported on an annular ring 128 spaced at mid-level above the lower end of the cylindrical housing. The outer cylindrical gate 126 is rotatable on the inner supporting housing 122 so that the slots 122*a* and 126*a* therein can be adjustably moved into or out of exact registry in order to control the flow or sand input from the bottom of the hoppers 102 into the interior of the housings 122. For this purpose, each outer cylindrical gate member 126 is provided with an arm 126*b* which is movable by a rod 129 extending outwardly through the adjacent wall of the hopper 102 and which carries a control hand wheel 130 rotatable for moving the rod inwardly and outwardly and thereby rotate the sleeve gate 126 on the housing 22 as indicated by the arrow "M" to control the effective flow area for the sand moving into the lift tube. A hand wheel 130 is provided for each scrubber cell to control the position of the sand inlet gate 126 and the slots 126*a* therein relative to the slots 122*a* in the fixed sand inlet housing 122. When the scrubber 10 is in operation, the hand wheels 130** of each cell are individually adjusted to tune and balance the sand flow through the scrubber in order to provide extremely efficient operation by precise flow control in each individual, serially interconnected scrubber cell.

In accordance with the present invention, each of the exhaust valve gate assemblies 60 includes a generally cylindrical fixed housing 132 supported at its upper edge from the top wall 100 of the head chamber 90 as best shown in FIGS. 6 and 7. As previously described, each gate assembly includes a circular bottom wall 56 spaced upwardly of the lower edge of the cylindrical housing 132 for supporting a target 50 as described. The housing is formed with a plurality of circumferentially spaced slots **132*a* above the wall 56 for passage of the exhaust air and fines from the lower operation zone into the cylindrical housing and eventually outwardly through the open upper end into an exhaust manifold 110. An annular support ring 134 is mounted on the outer surface of the cylindrical housing 132 to support a rotatable cylindrical gate 136 having slots 136*a* adapted to overlie and cooperate with the slots 132*a* of the inner cylindrical housing 132 as best shown in FIG. 8. The outer gate cylinder 136 is relatively rotatable on the ring 134 around the housing 132 as indicated by the arrow "T" (FIG. 8) in order to effectively control and regulate the area of the flow passage for the exhaust gases and fines passing out of the scrubber as indicated by the arrows "G" in FIGS. 7 and 8. It will thus be seen that the relative rotative position of the outer gate cylinder 136 and its housing 132 provides a means for precisely controlling the exhaust flow of air and fines from each of the scrubber cells 12, 14, 16 and 18. The position of the outer gate cylinder 136 is adjustable by means of a pair of radial arms 136*b* which are connected to the inner end of a control rod 138 which projects laterally outwardly through the adjacent sidewall 92 of the upper head chamber 90. The rods are provided with hand wheels 140 on the outer end which are rotatable for moving the control rods back and forth as indicated by the arrow "R" (FIG. 8) to selectively position the slots 136*a* on the outer gate cylinder 136 with the desired amount of registration with the slots 132*a* of the inner housing 132**.

In accordance with another aspect of the invention, the input flow of spent foundry sand or other particulate material to be treated in the scrubber 10 is closely metered by the inlet assembly 20 which includes a multi-bladed rotor 142 mounted on a shaft 144 which is driven by a motor 146 at a selectively controlled speed to thereby adjustably control or meter the input flow rate of material into the first cell 12 of the scrubber 10. The metering rotor 142 is mounted in the inlet chute 148 which is in communication with an inlet opening **96*a* provided in the inlet end wall 96 of the head chamber 90. The material to be treated flows into the chute 148 from a hopper or other supply source and is metered on a volumetric basis by the multi-bladed rotor 142 which is driven at a selectively controlled speed by the motor 146 in order to provide the precise control of flow rate of material. The multi-bladed inlet rotor 142** also provides a positive air lock at the inlet side of the scrubber and this minimizes air losses and reduces operational costs.

At the opposite or front end wall 94 of the head chamber 90, the outlet assembly 22 includes a similar multi-bladed outlet rotor 150 carried on a shaft 152 and driven at a selectively adjustable speed by a motor 154 for controlling or metering the output of finished material from the final scrubber cell 18. The outlet metering rotor is mounted in an outlet chute 156 which slopes downwardly from an outlet opening **94*a* in the front end wall 94 of the head chamber 90. The speed of the outlet rotor is selected to provide a desired output flow rate from the scrubber and balance the operating condition of the scrubber between the input and output end. The multi-bladed rotor 150 also provides a positive air lock for reducing air leakage at the outlet side head chamber 90** thus providing for more efficient operation of the scrubber unit by minimizing air loss.

From the foregoing it will be seen that the new and improved impact scrubber 10 in accordance with the present invention provides a number of innovative features including separate and independent sources of primary and secondary air which permit more precision in the control of sand or particulate material flow through the respective scrubber cells as well as more precise control of the fluid flow for effecting separation of the fines from the impact cleaned material moving through the unit. Each scrubber cell is provided with a primary air flow control mechanism and a primary sand inlet control mechanism. In addition, each scrubber cell includes an adjustably controllable exhaust valve gate mechanism and a selectively adjustable baffling system for dividing the impacted material into part streams, one for recycling and one for advancement into the next scrubbing cell. The input and output of material with respect to the scrubber as a whole is precisely controlled by the inlet and outlet assemblies and the overall operation of the scrubber may be precisely tuned as desired to minimize operational costs and reduce maintenance.

The provision of separate and independent primary and secondary air sources result in an energy efficient scrubber which costs less initially to build and which requires less operational and maintenance costs than previously known prior art scrubbers.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An impact scrubber for removing coating materials from the surfaces of particulate matter such as spent foundry sand and the like, said scrubber including one or more scrubber cells comprising:

a lift tube open adjacent upper and lower ends for containing a high velocity fluidized stream of said matter;

fluid injector means adjacent said lower end of said lift tube for moving said matter into said lift tube forming an upwardly flowing fluidized stream therein;

adjustable inlet valve means adjacent said fluid injector means for regulating the flow of said matter into said lower end of said lift tube;

target means spaced above the upper end of said lift tube providing an impact area for receiving the impact of said fluidized stream of matter and diverting said matter and said coating materials removed therefrom in a generally downwardly extending annular curtain concentrically around said lift tube;

means for directing a secondary fluid flow outwardly of said lift tube at a level below and adjacent the open upper end for angularly intercepting said curtain of flowing matter and coating material and separating said coating materials away from said particulate matter; and means for exhausting said separated coating materials along with said primary and secondary fluid separately away from said particulate matter.

2. The impact scrubber of claim 1 including a plurality of said scrubber cells and including:

a flow dividing baffle means for dividing a flow of particulate matter falling from the target means of a first cell into a pair of streams and directing one of said streams into a second of said cells and the other of said streams toward said fluid injector means of said first cell for recycling the material therein.

3. The impact scrubber of claim 1 including:

means for metering a flow of particulate matter to be treated in said scrubber into said scrubber cell at a selectively controlled input flow rate.

4. The impact scrubber of claim 1 including:

means for discharging particulate matter treated in said scrubber cell at a selectively controlled output flow rate.

5. The impact scrubber of claim 3 wherein said metering means includes rotary seal means providing an air seal between said cell and the atmosphere.

6. The impact scrubber of claim 4 wherein said discharge means includes rotary seal means providing an air seal between said cell and the atmosphere.

7. The impact scrubber of claim 1 including:

a plurality of said scrubber cells interconnected serially and including an inlet cell and an outlet cell, means for metering the flow of particulate material to be treated by said scrubber into said inlet cell at a selectively controlled input flow rate, and means for discharging said particulate material after treatment in said cells at a selectively controlled output rate.

8. The impact scrubber of claim 2 including a common head chamber for enclosing upper end portions of said scrubber cells, each of said cells including an adjustable exhaust valve in said fluid chamber for controlling the flow rate of separated coating materials exhausted from said scrubber.

9. The impact scrubber of claim 8 wherein said target means are supported by said exhaust valves at a level therebelow.

10. The impact scrubber of claim 9 wherein said target means of each scrubber cell is mounted in said head chamber.

11. The impact scrubber of claim 10 wherein each of said scrubber cells includes a hopper extending downwardly of said head chamber around said lift tube for directing said particulate matter from said target means toward said inlet valve means thereof.

12. The impact scrubber of claim 8 wherein said fluid injector means comprises a plenum chamber for pressurized fluid extending below the lift tube of each scrubber cell for supplying pressurized fluid thereto.

13. The impact scrubber of claim 12 or claim 1 wherein said fluid injector means includes a fluid nozzle coaxially aligned with each of said lift tubes for directing a jet of fluid from said plenum chamber into the lower open end of the adjacent lift tube.

14. The impact scrubber of claim 13 including valve means for selectively opening and closing each of said fluid nozzles.

15. The impact scrubber of claim 14 wherein said valve means includes a valve member movable coaxially into and out of said nozzle to control the fluid flow from said plenum chamber into said lift tube through said nozzle.

16. The impact scrubber of claim 1 or 2 wherein said secondary fluid flow means includes an annular, secondary fluid chamber around each of said lift tubes spaced below said target means thereon, said annular chamber including one or more frustroconically shaped top walls for directing said curtain of particulate matter and coating materials downwardly and outwardly of said lift tube and at least one annular fluid outlet opening below said top wall for directing said secondary fluid outwardly of said lift tube to intercept said curtain and separate said coating materials from said particulate matter in an annular separation zone below said target means.

17. The impact scrubber of claim 16 wherein said secondary fluid flow means includes a plurality of said frustoconically shaped top walls for each of said annular chambers, said top walls increasing in diameter downwardly of an upper top wall and an annular fluid outlet opening between each pair of adjacent top wall in each annular chamber.

18. The impact scrubber of claim 1 or 2 wherein said secondary fluid flow means includes a plenum chamber separate of said fluid injector means and an annular secondary fluid chamber around each of said lift tubes below said target means for directing fluid from said separate plenum chamber outwardly of said lift tube to intercept and carry away coating materials broken away from said particulate matter and falling downwardly around said secondary fluid chamber.

19. The impact scrubber of claim 1 or 2 including a selectively adjustable valve means adjacent each of said fluid injector means for controlling the flow of particulate matter into said fluidized stream.

20. The impact scrubber of claim 19 wherein each of said adjustable valve means includes a housing around the open lower end of said lift tube and at least one inlet opening for the flow of particulate matter into said housing, and a movable valve member mounted on said housing for movement to open and close said inlet opening thereof.

21. The impact scrubber of claim 20 wherein said valve member includes at least one inlet opening adapted to be moved toward and away from registration with said inlet opening of said housing.

22. The impact scrubber of claim 21 wherein said housing and valve members are generally cylindrical in coaxial alignment with said lift tube and are rotative relative to each other to selectively adjust the registration between said inlet openings thereof.

23. The impact scrubber of claim 1 or 2 wherein said exhausting means includes a selectively adjustable exhaust valve means adjacent each of said target means for controlling the flow of fluid carrying away said coating materials from said particulate matter.

24. The impact scrubber of claim 23 wherein each of said exhaust valve means includes a housing spaced above said target means and at least one exhaust opening for directing a flow of fluid and coating materials into said housing, and a movable valve member mounted on said housing for movement to open and close said exhaust opening thereof.

25. The impact scrubber of claim 24 wherein said valve member includes at least one exhaust opening adapted to be moved toward and away from registration with said exhaust opening of said housing.

26. The impact scrubber of claim 25 wherein said housing and valve members are generally cylindrical in coaxial alignment with said lift tube and are rotative relative to each other to selectively adjust the registration between said exhaust openings thereof.

27. The impact scrubber of claim 8 wherein said head chamber includes a wall having one or more exhaust openings therein and one of said adjustable exhaust valves adjacent each of said head chamber exhaust openings for controlling the flow rate of fluid and separated coating materials.

28. The impact scrubber of claim 27 wherein said wall comprises a top wall supporting an upper end of an exhaust valve around each of said exhaust openings.

29. The impact scrubber of claim 28 wherein said exhaust means includes an exhaust manifold in communication with all of said exhaust openings of said head chambers.

30. The impact scrubber of claim 29 including exhaust fan means connected with said exhaust manifold for moving said fluid and coating materials out of said scrubber through said manifold.

31. The impact scrubber of claim 27 wherein each of said exhaust valves includes a cylindrical housing in coaxial alignment with a lift tube above a target means and a movable valve member mounted on said housing for movement to open and close said exhaust opening thereof.

32. The impact scrubber of claim 31 wherein said valve member includes at least one exhaust opening adapted to be moved toward and away from registration with said exhaust opening of said housing.

* * * * *